4/12/83 XR 4,379,489

United States Patent [19]

Rollmann

[11] 4,379,489

[45] Apr. 12, 1983

[54] METHOD FOR PRODUCTION OF HEAVY OIL FROM TAR SANDS

[75] Inventor: Louis D. Rollmann, Princeton, N.J.

[73] Assignee: Mobil Oil Corporation, New York, N.Y.

[21] Appl. No.: 209,355

[22] Filed: Nov. 24, 1980

[51] Int. Cl.[3] ..... E21B 43/22; E21B 43/24; E21B 43/40

[52] U.S. Cl. ..... 166/266; 166/272; 166/274; 166/300

[58] Field of Search ..... 166/260, 266, 267, 270, 166/271, 272, 273, 274, 300, 303, 305 R, 307

[56] References Cited

U.S. PATENT DOCUMENTS

| | | | |
|---|---|---|---|
| 2,910,123 | 10/1959 | Elkins | 166/271 |
| 3,167,119 | 1/1965 | Meadors | 166/274 |
| 3,249,157 | 5/1966 | Brigham et al. | 166/273 |
| 3,259,187 | 7/1966 | Prats et al. | 166/270 |
| 3,326,289 | 6/1967 | Mulder | 166/270 X |
| 3,333,632 | 8/1967 | Kyte | 166/274 X |
| 3,353,597 | 11/1967 | Mulder | 166/266 X |

*Primary Examiner*—Stephen J. Novosad
*Assistant Examiner*—George A. Suchfield
*Attorney, Agent, or Firm*—Charles A. Huggett; Michael G. Gilman; Edward F. Kenehan, Jr.

[57] ABSTRACT

An enhanced recovery process in which liquid sulfur is burned in an oyxgen-containing gas underground to form $SO_2$. The $SO_2$ may itself act as a drive fluid for the recovery of oil or it may react with limestone in the formation to form $CO_2$, an alternate drive fluid.

6 Claims, No Drawings

METHOD FOR PRODUCTION OF HEAVY OIL FROM TAR SANDS

BACKGROUND OF THE INVENTION

1. Field of the Invention

This invention is concerned with the production of heavy oil from underground deposits of tar sands.

2. Description of the Prior Art

In applicant's copending application Ser. No. 189,997, filed Sept. 23, 1980, there is disclosed a process for extracting organic matter from tar sands with liquid sulfur dioxide. The process is particularly applicable to tar sands that have been mined and transported to a plant for the extraction operation. There are, however, vast deposits of tar sands and other heavy oil reservoirs that are underground and are not susceptible to mining. For example, the Athabasca tar sands in Alberta Province, Canada, have been estimated to contain 860 billion bbls. with only 26 billion bbls. recoverable by current technology. Since the heavy oil in tar sands is highly viscous to ambient formation temperatures, it is not recoverable in its natural state through a well by ordinary production methods. Resort must be had to techniques to make the heavy oil more readily flowable, such as a suitable solvent or heat, or a combination thereof.

It has been proposed to use various water-flooding processes, including the use of aqueous solutions of sulfur dioxide, in the recovery of flowable oil from subterranean reservoirs. Insofar as is now known, however, the process of this invention for recovering heavy oil has not been proposed.

SUMMARY OF THE INVENTION

This invention provides in the production of heavy oil from a subterranean reservoir penetrated by spaced injection and recovery systems, the method comprising:

(a) introducing into said injection system adjacent to said reservoir liquid sulfur and oxygen-containing gas, thereby obtaining a mixture of sulfur and oxygen-containing gas, (b) igniting said mixture to produce sulfur dioxide, (c) maintaining the pressure of said oxygen-containing gas sufficient to keep said sulfur dioxide in the liquid state, at the temperature of the reservoir.

(d) flowing liquid sulfur dioxide into said reservoir, whereby there is formed a solution of heavy oil in the reservoir in said liquid sulfur dioxide, (e) flowing said solution toward said production system, and (f) recovering said solution from said production system.

DESCRIPTION OF SPECIFIC EMBODIMENTS

The method of this invention is applicable to any subterranean reservoir that contains heavy oil, i.e., an oil or bitumen having an API gravity less than 16°. It is particularly applicable to the production of heavy oil from subterranean tar sand beds. The following description is specifically directed to tar sand beds, but it will be recognized that the method is applicable to any reservoir or formation containing heavy oil.

The present invention is carried out in a subterranean tar sand bed that is penetrated by spaced injection and recovery systems extending from the surface of the earth into the tar sand bed. The injection system consists of one or more wells into which are introduced liquid sulfur and an oxygen-containing gas. The recovery system comprises one or more wells from which product is recovered. The wells in the injection and recovery systems are spaced apart and can be arranged in any desired pattern, such as patterns well known in waterflood operations. For example, the pattern can comprise a central injection well and a plurality of recovery wells spaced radially about the injection well.

In carrying out the invention, liquid sulfur and an oxygen-containing gas are introduced into the injection well in an area adjacent to the tar sand bed. Sulfur is readily available, as substantial sulfur surpluses are accumulating on-site with current processing sequences.

The oxygen-containing gas can be air, although other oxygen-containing gases can be used, such as oxygen-enriched air or even pure oxygen. Although the oxygen ($O_2$): sulfur mole ratio may range from about 0.1 to 2, in the combustion of the sulfur to sulfur dioxide, a substantially stoichiometric amount of oxygen will normally be used.

The sulfur and oxygen-containing gas introduced into the injection well admix in the area adjacent to the tar sand bed and the mixture is ignited to form sulfur dioxide. Any means can be used to ignite the mixture. For example, an electric heater can be placed in the injection well and activated to heat the mixture to combustion temperatures.

Liquid, not gaseous, sulfur dioxide has been found to be a solvent for the organic matter in tar sand. Thus, the sulfur dioxide must be under pressure sufficient to obtain a liquid phase of reservoir temperatures. This can be accomplished by introducing the sulfur and the oxygen-containing gas under pressure.

The liquid sulfur dioxide flows into the tar sand bed toward the recovery system. En route the liquid sulfur dioxide dissolves the organic matter in the tar sand and transports it to the recovery system. In reservoirs that contain limestone, the liquid sulfur dioxide in the presence of water contained in the tar sand bed reacts with the limestone to release carbon dioxide. The carbon dioxide so formed serves as an additional drive fluid to force the dissolved organic matter toward the recovery system. The dissolved organic matter is recovered from the recovery system by conventional production procedures.

Other drive means may be employed to force the dissolved organic matter toward the recovery system, such as waterflooding, polymer flood, and chemical waterflood. It is optionally contemplated to separate the sulfur dioxide from the dissolved organic matter above ground, as by flashing, and recycling it to the injection system.

The efficacy of liquid sulfur dioxide to extract organic matter from tar sand and to react with limestone to produce carbon dioxide was demonstrated in a small-scale pressurized flow apparatus, comprising a vertical stainless steel tube having 50 cc. Jerguson (sight) gauges at the top and the bottom. The sample was placed in the tube and heated to the desired operating temperature under helium, the Jerguson gauges being at room temperature. The liquid sulfur dioxide (and water in the case of limestone) was trickled through the sample and collected in the Jerguson gauge at the bottom.

EXAMPLE 1

A 25 g. sample of oil sand from Oil Creek, Oklahoma, was placed in the flow apparatus and 24 cc. liquid $SO_2$ was passed down flow at 90° C. under 800 psig. The original sample contained 4.8% carbon and 6.1% volatiles (after drying at 150° C.). The $SO_2$ treatment extracted 83% of the oil in the sample.

EXAMPLE 2

A 60 cc, mixture of 60% $SO_2$ and 40% water was flowed through a Todeto limestone sample in 20 minutes under 800 psig. at 90% c. About 25% of the calcium carbonate was converted to the sulfite (or sulfate) with evolution of $CO_2$.

Although the present invention has been described with preferred embodiments, it is to be understood that modifications and variations may be resorted to, without departing from the spirit and scope of this invention, as those skilled in the art will readily understand. Such variations and modifications are considered to be within the purview and scope of the appended claims.

What is claimed is:

1. In the production of heavy oil from a subterranean reservoir penetrated by spaced injection and recovery systems, the method comprising:

(a) introducing into said injection system adjacent to said reservoir liquid sulfur and oxygen-containing gas, thereby obtaining a mixture of sulfur and oxygen-containing gas, (b) igniting said mixture to produce sulfur dioxide, (c) maintaining the pressure of said oxygen-containing gas sufficient to keep said sulfur dioxide in the liquid state, at the temperature of the reservoir.

(d) flowing liquid sulfur dioxide into said reservoir, whereby there is formed a solution of heavy oil in the reservoir in said liquid sulfur dioxide, (e) flowing said solution toward said production system, and (f) recovering said solution from said production system.

2. The method of claim 1 wherein said oxygen-containing gas is air.

3. The method of claim 1 wherein the oxygen: sulfur mole ratio is 0.1 to 2.

4. The method of claim 1 wherein the oxygen: sulfur ratio is stoichiometric.

5. The method of claim 1 wherein sulfur dioxide is separated from said solution, recovered from the production system and is recycled to said injection system.

6. The method of claim 1 wherein said liquid sulfur dioxide reacts with any limestone in the reservoir to form carbon dioxide as additional drive fluid.

* * * * *